US005779565A

United States Patent [19]

Adams

[11] Patent Number: 5,779,565

[45] **Date of Patent: *Jul. 14, 1998**

[54] FAIRWAY WOOD FOR TIGHT LIES

[75] Inventor: Byron H. Adams, Dallas, Tex.

[73] Assignee: Adams Golf, Plano, Tex.

[ * ] Notice: The portion of the term of this patent subsequent to Nov. 4, 2014, has been disclaimed.

[21] Appl. No.: 744,153

[22] Filed: Nov. 12, 1996

[51] Int. Cl.[6] ..... A63B 53/04

[52] U.S. Cl. ..... 473/328; 473/324; 473/314

[58] Field of Search ..... 473/324, 327, 473/330, 290, 291, 314, 328

[56] References Cited

U.S. PATENT DOCUMENTS

| | | | |
|---|---|---|---|
| 1,533,638 | 4/1925 | Dutcher | 473/327 |
| 1,868,286 | 7/1932 | Grieve | 473/328 |
| 5,240,252 | 8/1993 | Schmidt et al. | 473/327 |
| 5,255,914 | 10/1993 | Schroder | 473/314 X |
| 5,271,620 | 12/1993 | Moriguchi et al. | 473/324 |
| 5,301,941 | 4/1994 | Allen | 473/327 |
| 5,354,054 | 10/1994 | Akatsuka et al. | 473/324 X |
| 5,465,970 | 11/1995 | Adams et al. | 473/327 |
| 5,573,469 | 11/1996 | Dekura | 473/328 X |

*Primary Examiner*—Raleigh W. Chiu
*Attorney, Agent, or Firm*—Aquilino & Welsh

[57] ABSTRACT

A fairway type metal wood golf club head having a low profile and an upright trapezoidal shape providing a low center of gravity to facilitate getting a golf ball airborne from a tight or rough lie condition.

8 Claims, 1 Drawing Sheet

FAIRWAY WOOD FOR TIGHT LIES

BACKGROUND OF THE INVENTION

The present invention relates to metal wood type golf club heads and, in particular, to a fairway type metal wood golf club head having an improved aerodynamic shape and weight configuration.

In prior U.S. Pat. No. 5,465,970 to Adams et al., a metal wood type golf club is described having aerodynamic characteristics and a lower center of gravity formed by an upright trapezoidal shape wherein the bottom or sole surface of the club head is significantly larger than the top surface. The side walls of the club head extend downwardly and outwardly from the top surface to the bottom of the club head. This specific configuration is extremely effective for hitting a golf ball struck from a tee where the ball equator can be precisely positioned by the golfer to coincide with individual preference and angle of attack.

SUMMARY OF THE INVENTION

The present invention incorporates the design characteristics of the aforementioned patent with dimensional modifications that substantially enhance the playability of a golf ball lying in a non-teed location such as on a fairway or in a rough situation. The structure of the present invention provides a maximum low center of gravity relative to the ball equator with the ball lying in a non-teed lie position.

Furthermore the club head sets up to the ball in such a way so as to provide a positive visualization that inspires confidence a golfer when confronted with difficult lie situations. The golf club has a low profile wherein the top to bottom dimension of the club face is 25% less than the aforementioned patent which, in turn, lowers the center of gravity. More specifically, the ratio of the heel to toe dimension of the club face, to the top surface to lower surface dimension is at least 3 to 1 and may be up to 4 to 1. Conventional golf clubs have a ratio of the heel to toe dimension, to the top surface to bottom surface dimension of approximately 2 to 2½ to one. The lowering of the center of gravity relative to a golf ball creates a maximum opportunity to lift the ball into the air without adding loft to the club head. This ability to maintain the club head launch angle without added loft avoids dissipation of velocity energy to spin energy, which often results in a loss of distance. By reducing the top to bottom face dimension and maintaining the same heel to toe dimension, the club head visualization presented to the golfer in an address position establishes confidence that the ball can be lifted into the air. This allows the golfer to perform comfortably with his normal wood swing without modifying his swing to a shortened downward blow normally equated with an iron swing.

Finally, the surface area reduction of the club head further reduces aerodynamic drag and creates a low profile face that resists undesired torquing of the club head in unmanicured fairway or rough conditions. Furthermore, the maintenance of the heel to toe dimension maintains the same high moment of inertia achieved in the aforementioned patent.

The fairway type metal woods of the present invention incorporate an upright trapezoidal configuration, that is, the top surface is smaller than the bottom surface and the sides extend downwardly and outwardly in a top to bottom direction. The club is further characterized by a bottom surface which is convex in shape presenting a parabolic leading edge in the heel to toe direction.

Among the objects of the present invention is the provision of a fairway type metal wood having maximum playability characteristics from tight fairway lies or rough locations.

Another object of the present invention is the provision of a fairway type metal wood having a lower center of gravity for maximizing the launch angle when a golf ball is struck from a tight fairway lie or rough location.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENTS

Figure 1:
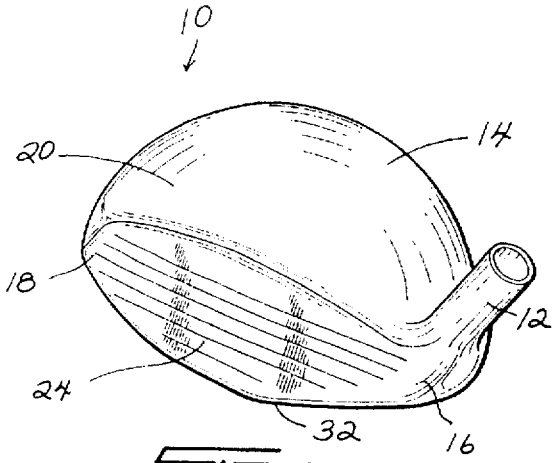
FIG. 1 is a top/front perspective of a fairway metal wood golf club of the present invention.
Figure 2:
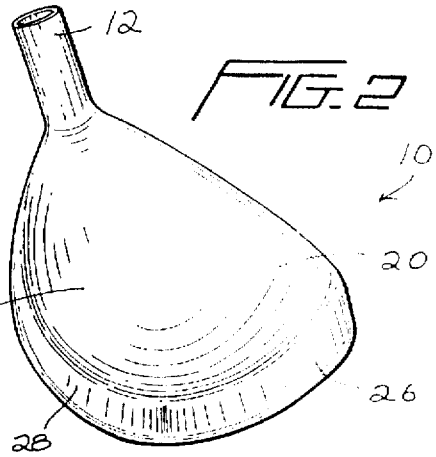
FIG. 2 is a top/rear perspective view thereof.
Figure 3:
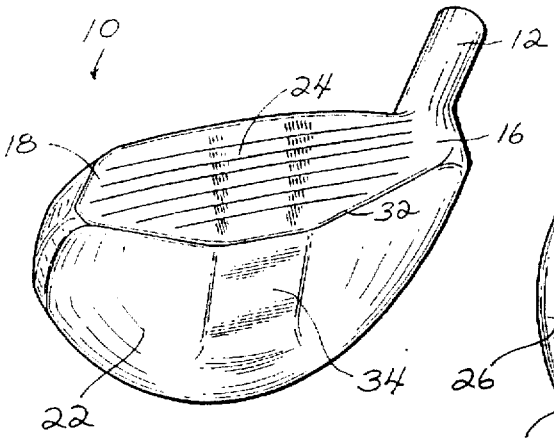
FIG. 3 is a front/bottom perspective view thereof.
Figure 4:
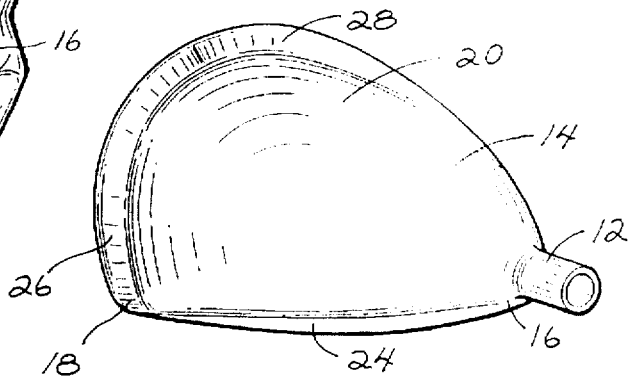
FIG. 4 is a top plan view thereof.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, a fairway type metal wood 10 in accordance with the present invention is provided with a hosel 12 for connection to a golf shaft (not shown) and a club head body 14. The club head body includes a heel 16, toe 18, top surface 20, bottom or sole surface 22, ball striking face 24, a toe side surface 26, a rear surface 28 and a heel side surface 30. The club head includes a leading edge 32 at the intersection of the ball striking face 24 and bottom surface 22, which is parabolic in shape in the heel 16 to toe 18 direction. The sole surface 22 is convex in shape and includes a centrally positioned, flat surface 34 extending perpendicular to and rearwardly from the leading edge 32.

As can be seen from the drawings, the top surface 20 is significantly smaller than the bottom surface 22. The heel side surface 30, the toe side surface 26 and the rear surface 28 flow smoothly into each other and extend downwardly and outwardly from the top surface 20 to the bottom surface 22 in a generally upright trapezoidal configuration when viewed in elevation.

The distance between the top surface 20 and the bottom surface 22 is reduced approximately 25% of the same distance on conventional golf club heads. Overall, the ratio of the heel to toe dimension of the ball striking face to the top surface to bottom surface dimension of the ball striking face is at least 3 to 1 and may be up to 4 to 1. In a preferred embodiment, the heel to toe dimension of the ball striking face is 4 inches wide, whereas the top surface to bottom surface dimension is approximately 1 inch, creating a 4 to 1 ratio.

The flattened, low profile configuration and shape of the club head 10 lowers the center of gravity relative the equator of a golf ball during the execution of a golf stroke. This lower center of gravity allows a golfer to optimize the launch angle when using the club from a tight fairway lie or rough location.

Figure 5:
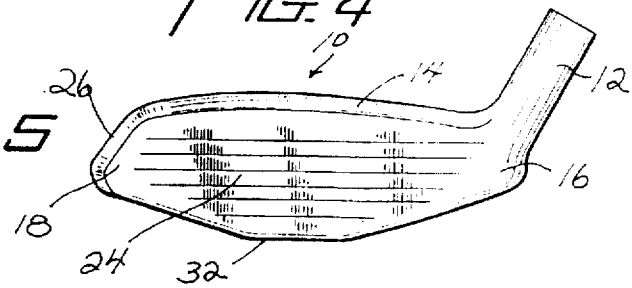
FIG. 5 is a front elevational view thereof.
Figure 6:
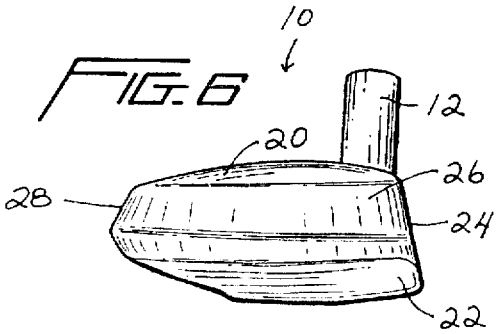
FIG. 6 is an end elevational view thereof.
Figure 7:
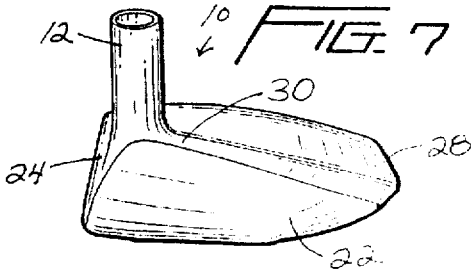
FIG. 7 is an end elevational view taken from the opposite end of FIG. 6.

Referring to the front elevational view, FIG. 5, it can be seen that the heel 16 extends outwardly from a center line of the hosel at an angle of approximately fifteen degrees. This structure further stabilizes the connection between the shaft and the club head body 14.

Referring to the same FIG. 5, the overall dimension between the outermost bulge on the top surface to the outermost bulge on the bottom surface is preferably 1⅜0 inches and does not exceed 1½ inches. The club head 10 has a leading edge 32 between the ball striking face 24 and the bottom surface 22 which is generally parabolic in shape, as seen in FIG. 5, extending upwardly toward the toe 18 and heel 16. The bottom surface 22 also includes a flat surface 34 extending rearwardly from the ball striking face 24 which acts as a skid member to stabilize the club head 10 when it makes contact with the ground surface during the execution of a golf swing.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A fairway type metal wood golf club head, comprising:

a club head body having a heel, toe, top surface, bottom surface, rear surface, side and rear walls and ball striking face;

said club head characterized by an upright trapezoidal geometry wherein said bottom surface has a greater area than said top surface, and said side and rear walls are angled upwardly and inwardly from an outer periphery of said bottom surface to an outer periphery of said top surface;

said club head body being further characterized by a low profile ball striking face wherein the ratio of the dimension of the heel to toe distance on said ball striking face and the dimension of the top surface to bottom surface distance on the ball striking face is at least 3 to 1.

2. The fairway metal wood golf club head of claim 1, wherein said bottom surface is convex in shape and said club head includes a leading edge having an upward parabolic shape between the heel and toe respectively.

3. The fairway metal wood golf club head of claim 2, further including a flat surface extending rearwardly from said leading edge on said bottom surface at least part way to said rear surface of said club head.

4. The fairway metal wood golf club head of claim 1, wherein said heel is characterized by an extension outwardly from a center line of said hosel.

5. The fairway metal wood golf club head of claim 4, wherein said heel extension forms an angle of approximately fifteen degrees with said hosel midline.

6. The fairway metal wood golf club head of claim 1, wherein a point on said top surface extending the furthest outwardly from the center of said club head body to a point on said bottom surface extending outwardly the furthest from the center of said club head body does not exceed 1½ inches.

7. The fairway metal wood golf club head of claim 1 wherein said ratio is approximately 4 to 1.

8. The fairway metal wood golf club head of claim 7 wherein said bottom surface includes a centrally positioned, flat surface extending rearwardly from ball striking face.

* * * * *